US008555764B2

(12) United States Patent
Le et al.

(10) Patent No.: US 8,555,764 B2
(45) Date of Patent: Oct. 15, 2013

(54) PERFORATING GUN ASSEMBLY AND METHOD FOR CONTROLLING WELLBORE PRESSURE REGIMES DURING PERFORATING

(75) Inventors: Cam Van Le, Houston, TX (US); Darren Ross Barlow, Houston, TX (US); Jeffrey Alan Nelson, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/104,014

(22) Filed: May 9, 2011

(65) Prior Publication Data

US 2011/0209871 A1 Sep. 1, 2011

Related U.S. Application Data

(63) Continuation-in-part of application No. 12/512,530, filed on Jul. 30, 2009, now Pat. No. 8,336,437.

(60) Provisional application No. 61/222,106, filed on Jul. 1, 2009.

(51) Int. Cl.
*E21B 43/117* (2006.01)

(52) U.S. Cl.
USPC ..... 89/1.15; 102/310; 102/320; 102/313; 166/55.1; 166/63; 175/4.6

(58) Field of Classification Search
USPC ..... 102/306, 307, 308, 309, 310, 313, 320, 102/476; 166/297, 298, 299, 55, 55.1, 55.2, 166/63; 175/4.6; 89/1.15
See application file for complete search history.

(56) References Cited

U.S. PATENT DOCUMENTS

| | | | |
|---|---|---|---|
| 3,924,510 | A | 12/1975 | Strunk et al. |
| 4,220,687 | A | 9/1980 | Christopher |
| 4,290,486 | A | 9/1981 | Regalbuto |
| 5,098,487 | A | 3/1992 | Brauer et al. |
| 5,295,545 | A | 3/1994 | Passamaneck |
| 5,775,426 | A | 7/1998 | Snider et al. |
| 6,158,511 | A | 12/2000 | Wesson |

(Continued)

FOREIGN PATENT DOCUMENTS

DE 102005059934 A1 8/2006

OTHER PUBLICATIONS

Office Action—Restriction Requirement dated Jul. 16, 2012, U.S. Appl. No. 12/720,522, filed Mar. 9, 2010.
Office Action dated Jul. 3, 2012, U.S. Appl. No. 13/128,094, filed Jul. 8, 2011.
Office Action dated May 26, 2011, U.S. Appl. No. 12/512,530, filed Jul. 30, 2009.

(Continued)

*Primary Examiner* — James Bergin

(57) ABSTRACT

A downhole tool gun string assembly comprises a first perforating gun operable to generate a first pressure at a first location in a wellbore, wherein the first perforating gun comprises a first plurality of perforating charges; a second perforating gun operable to generate a second pressure at a second location in the wellbore, wherein the second pressure is different from the first pressure and the second perforating gun comprises a second plurality of perforating charges, and wherein at least one of the second plurality of perforating charges is operably associated with a secondary pressure generator, where the first perforating gun and the second perforating gun are configured to maintain a pressure at a selected location in the wellbore below a threshold when the first and second perforating guns are activated substantially concurrently.

20 Claims, 4 Drawing Sheets

(56) References Cited

U.S. PATENT DOCUMENTS

| | | | | |
|---|---|---|---|---|
| 6,263,283 | B1 | 7/2001 | Snider et al. | |
| 6,336,506 | B2 | 1/2002 | Wesson | |
| 6,347,673 | B1 | 2/2002 | Dailey | |
| 6,378,438 | B1 | 4/2002 | Lussier et al. | |
| 6,386,288 | B1 | 5/2002 | Snider et al. | |
| 6,446,719 | B2 | 9/2002 | Ringgenberg et al. | |
| 6,446,720 | B1 | 9/2002 | Ringgenberg et al. | |
| 6,527,052 | B2 | 3/2003 | Ringgenberg et al. | |
| 6,536,524 | B1 | 3/2003 | Snider | |
| 6,543,538 | B2 * | 4/2003 | Tolman et al. | 166/284 |
| 6,554,081 | B1 | 4/2003 | Brooks et al. | |
| 6,598,682 | B2 | 7/2003 | Johnson et al. | |
| 6,732,798 | B2 | 5/2004 | Johnson et al. | |
| 6,761,219 | B2 | 7/2004 | Snider et al. | |
| 6,840,178 | B2 | 1/2005 | Collins et al. | |
| 6,874,579 | B2 | 4/2005 | Johnson et al. | |
| 6,896,059 | B2 | 5/2005 | Brooks et al. | |
| 6,966,377 | B2 | 11/2005 | Johnson et al. | |
| 7,011,027 | B2 | 3/2006 | Reese et al. | |
| 7,036,594 | B2 | 5/2006 | Walton et al. | |
| 7,182,138 | B2 | 2/2007 | Behrmann et al. | |
| 7,243,725 | B2 | 7/2007 | George et al. | |
| 7,284,612 | B2 | 10/2007 | Ratanasirigulchai et al. | |
| 7,287,589 | B2 | 10/2007 | Grove et al. | |
| 7,393,423 | B2 | 7/2008 | Liu | |
| 7,428,921 | B2 | 9/2008 | Grove et al. | |
| 7,451,819 | B2 | 11/2008 | Chang et al. | |
| 7,533,722 | B2 | 5/2009 | George et al. | |
| 7,571,768 | B2 * | 8/2009 | Cuthill | 166/297 |
| 7,621,332 | B2 | 11/2009 | Haney et al. | |
| 7,905,285 | B2 * | 3/2011 | Cuthill | 166/297 |
| 7,913,761 | B2 | 3/2011 | Pratt et al. | |
| 8,156,871 | B2 | 4/2012 | Behrmann et al. | |
| 8,336,437 | B2 | 12/2012 | Barlow et al. | |
| 8,381,652 | B2 | 2/2013 | Glenn | |
| 8,449,798 | B2 | 5/2013 | Walker | |
| 2002/0178962 | A1 | 12/2002 | Reese et al. | |
| 2003/0131749 | A1 | 7/2003 | Lussier | |
| 2004/0089449 | A1 | 5/2004 | Walton et al. | |
| 2005/0011395 | A1 | 1/2005 | Langan | |
| 2006/0118303 | A1 | 6/2006 | Schultz et al. | |
| 2006/0266551 | A1 | 11/2006 | Yang et al. | |
| 2007/0034369 | A1 | 2/2007 | Ratanasirigulchai et al. | |
| 2007/0158109 | A1 | 7/2007 | Zazovsky et al. | |
| 2008/0034951 | A1 | 2/2008 | Evans et al. | |
| 2008/0289529 | A1 | 11/2008 | Schilling | |
| 2009/0050321 | A1 | 2/2009 | Rhodes et al. | |
| 2009/0078144 | A1 | 3/2009 | Behrmann et al. | |
| 2009/0078420 | A1 | 3/2009 | Caminari et al. | |
| 2009/0084552 | A1 | 4/2009 | Behrmann et al. | |
| 2009/0183916 | A1 | 7/2009 | Pratt et al. | |
| 2010/0096136 | A1 | 4/2010 | Bourne et al. | |
| 2010/0132945 | A1 | 6/2010 | Bell et al. | |
| 2010/0133005 | A1 | 6/2010 | Bell et al. | |
| 2010/0230104 | A1 | 9/2010 | Nölke et al. | |
| 2011/0000669 | A1 | 1/2011 | Barlow et al. | |
| 2011/0155013 | A1 | 6/2011 | Boyer et al. | |
| 2011/0219978 | A1 | 9/2011 | Glenn | |
| 2012/0027883 | A1 | 2/2012 | Walker | |
| 2012/0234194 | A1 | 9/2012 | Glenn | |
| 2013/0000979 | A1 | 1/2013 | Le et al. | |
| 2013/0008655 | A1 | 1/2013 | Le et al. | |

OTHER PUBLICATIONS

Walker, Jerry L., Patent Application entitled "High Density Powdered Material Liner," filed May 6, 2011, U.S. Appl. No. 13/128,094.

Atwood, D.C., et al., "Flow Performance of Perforation Tunnels Created with Shaped Charges Using Reactive Liner Technology," Society of Petroleum Engineers (SPE) European Formation Damage Conference, May 2009, The Netherlands.

Fischer, S.H., et al., "A Survey of Combustible Metals, Thermites, and Intermetallics for Pyrotechnic Applications," 32nd AIAA/ASME/SAE/ASEE Joint Propulsion Conference, Jul. 1996, Sandia National Laboratories, Albuquerque, NM, US.

Foreign Communication From a Related Counterpart Application—International Search Report and Written Opinion, PCT/US2010/039059, Mar. 30, 2011.

Foreign Communication From a Related Counterpart Application—International Search Report and Written Opinion, PCT/US2011/027638, Sep. 30, 2011.

Notice of Allowance dated Nov. 9, 2012, U.S. Appl. No. 12/512,530, filed Jul. 30, 2009.

Restriction Requirement dated Nov. 29, 2012, U.S. Appl. No. 13/610,855, filed Sep. 11, 2012.

Notice of Allowance dated Dec. 6, 2012, U.S. Appl. No. 12/720,522, filed Mar. 9, 2010.

Le, Cam Van, et al., Patent Application entitled, Perforating Gun Assembly and Method for Controlling Wellbore. Pressure Regimes During Perforating, filed Sep. 11, 2012, U.S. Appl. No. 13/610,853.

Le, Cam Van, et al., Patent Application entitled, Perforating Gun Assembly and Method for Controlling Wellbore Pressure Regimes During Perforating, filed Sep. 11, 2012, U.S. Appl. No. 13/610,855.

Walker, Jerry L, Patent Application entitled, "High Density Powdered Material Liner", filed Jul. 31, 2012, U.S. Appl. No. 13/563,719.

Restriction Requirement dated Sep. 27, 2012, Application Serial No. 13/463,458, filed May 3, 2012.

Walker, Jerry L., Patent Application entitled, "High Density Powdered Material Liner", filed Apr. 4, 2013, U.S. Appl. No. 13/857,145.

Restriction Requirement dated Apr. 18, 2013, U.S. Appl. No. 13/610,855, filed Sep. 11, 2012.

Supplemental Notice of Allowability dated Jan. 8, 2013, U.S. Appl. No. 12/720,522, filed Mar. 9, 2010.

Restriction Requirement dated Feb. 12, 2013, U.S. Appl. No. 13/463,458, filed May 3, 2012.

Office Action dated Apr. 13, 2012, U.S. Appl. No. 12/512,530, filed Jul. 30, 2009.

Glenn, Corbin S., Application entitled, "Shaped Charge Liner Comprised of Reactive Materials," U.S. Appl. No. 13/463,458, filed May 3, 2012.

Foreign Communication from a Related Counterpart Application—International Search Report and Written Opinion, PCT/US2011/036156, Feb. 17, 2012.

Office Action dated Dec. 21, 2011, U.S. Appl. No. 12,720,522, filed Mar. 9, 2010.

Office Action Restriction dated Nov. 25, 2011, U.S. Appl. No. 12/512,530, filed Jul. 30, 2009.

* cited by examiner

PERFORATING GUN ASSEMBLY AND METHOD FOR CONTROLLING WELLBORE PRESSURE REGIMES DURING PERFORATING

CROSS-REFERENCE TO RELATED APPLICATIONS

This application is a continuation-in-part of and claims priority to U.S. patent application Ser. No. 12/512,530 filed on Jul. 30, 2009, which claims priority to Provisional Application No. 61/222,106, filed on Jul. 1, 2009, both of which are incorporated herein by reference in their entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Without limiting the scope of the present invention, its background will be described with reference to perforating a subterranean formation using a perforating gun, as an example.

After drilling the various sections of a subterranean wellbore that traverses a formation, individual lengths of relatively large diameter metal tubulars are typically secured together to form a casing string that is positioned within the wellbore. This casing string increases the integrity of the wellbore and provides a path for producing fluids from the producing intervals to the surface. Conventionally, the casing string is cemented within the wellbore. To produce fluids into the casing string, hydraulic openings or perforations must be made through the casing string, the cement and a short distance into the formation.

Typically, these perforations are created by detonating a series of shaped charges that are disposed within the casing string and are positioned adjacent to the formation. Specifically, one or more perforating guns are loaded with shaped charges that are connected with a detonator via a detonating cord. The perforating guns are then connected within a tool string that is lowered into the cased wellbore at the end of a tubing string, wireline, slick line, coil tubing or other conveyance. Once the perforating guns are properly positioned in the wellbore such that the shaped charges are adjacent to the formation to be perforated, the shaped charges may be detonated, thereby creating the desired hydraulic openings.

The perforating operation may be conducted in an overbalanced pressure condition, wherein the pressure in the wellbore proximate the perforating interval is greater than the pressure in the formation or in an underbalanced pressure condition, wherein the pressure in the wellbore proximate the perforating interval is less than the pressure in the formation. When perforating occurs in an underbalanced pressure condition, formation fluids flow into the wellbore shortly after the casing is perforated. This inflow is beneficial as perforating generates debris from the perforating guns, the casing and the cement that may otherwise remain in the perforation tunnels and impair the productivity of the formation. As clean perforations are essential to a good perforating job, perforating in an underbalanced condition is preferred. It has been found, however, that due to safety concerns, maintaining an overbalanced pressure condition during most well completion operations is preferred. For example, if the perforating guns were to malfunction and prematurely initiate creating communication paths to a formation, the overbalanced pressure condition will help to prevent any uncontrolled fluid flow to the surface.

To overcome the safety concerns but still obtain the benefits associated with underbalanced perforating, efforts have been made to create a dynamic underbalance condition in the wellbore immediately following charge detonation. The dynamic underbalance is a transient pressure condition in the wellbore during the perforating operation that allows the wellbore to be maintained at an overbalanced pressure condition prior to perforating. The dynamic underbalance condition can be created using hollow carrier type perforating guns, which consists of an outer tubular member that serves as a pressure barrier to separate the explosive train from pressurized wellbore fluids prior to perforating. The interior of the perforating guns contains the shaped charges, the detonating cord and the charge holder tubes. The remaining volume inside the perforating guns consists of air at essentially atmospheric pressure. Upon detonation of the shaped charges, the interior pressure rises to tens of thousands of psi within microseconds. The detonation gases then exit the perforating guns through the holes created by the shaped charge jets and rapidly expand to lower pressure as they are expelled from the perforating guns. The interior of the perforating guns becomes a substantially empty chamber which rapidly fills with the surrounding wellbore fluid. Further, as there is a communication path via the perforation tunnels between the wellbore and reservoir, formation fluids rush from their region of high pressure in the reservoir through the perforation tunnels and into the region of low pressure within the wellbore and the empty perforating guns. All this action takes place within milliseconds of gun detonation.

While creating a dynamic underbalance is beneficial in many circumstances, it has been found that there are some circumstances where excessive dynamic underbalance causes the perforation tunnel to fail due to, for example, sanding. A need has therefore arisen for an apparatus and method for perforating a cased wellbore that create effective perforation tunnels. A need has also arisen for such an apparatus and method that provide for safe installation and operation procedures. Further, a need has arisen for such an apparatus and method that manage wellbore pressure regimes and the dynamic underbalance phenomena.

SUMMARY

In an embodiment, a downhole tool gun string assembly comprises a first perforating gun operable to generate a first pressure at a first location in a wellbore, wherein the first perforating gun comprises a first plurality of perforating charges; a second perforating gun operable to generate a second pressure at a second location in the wellbore, wherein the second pressure is different from the first pressure and the second perforating gun comprises a second plurality of perforating charges, and wherein at least one of the second plurality of perforating charges is operably associated with a secondary pressure generator, where the first perforating gun and the second perforating gun are configured to maintain a pressure at a selected location in the wellbore below a threshold when the first and second perforating guns are activated substantially concurrently.

In an embodiment, a method comprises a. determining a configuration of a gun string; b. determining, by a computer, a pressure transient at a desired location in a wellbore, wherein the desired location has one or more pressure thresholds; and wherein the pressure transient comprises one or more pressures; c. comparing the one or more pressures with the one or more pressure thresholds at the desired location; and d. perforating the wellbore with the gun string using the determined configuration of the gun string when the one or more pressures meet the one or more pressure thresholds at the desired location. The method can also comprise e. redetermining the configuration of the gun string when the one or more pressures exceed the one or more pressure thresholds at the desired location; and f. repeating steps b. through c.

In an embodiment, a method comprises providing a gun string assembly within a wellbore, where the gun string assembly comprises a plurality of perforating guns coupled in series. A first perforating gun of the plurality of perforating guns comprises a first portion of shaped charges. A second perforating gun of the plurality of perforating guns comprises a second portion of shaped charges operably associated with a secondary pressure generator. The method also comprises perforating the wellbore using the gun string assembly, wherein the first perforating gun and the second perforating gun are configured in the gun string assembly to provide a pressure transient comprising one or more pressures at a desired location in the wellbore that meet one or more thresholds.

The present invention disclosed herein comprises an apparatus and method for perforating a cased wellbore that create effective perforation tunnels. The apparatus and method of the present invention also provide for safe installation and operation procedures as well as for the management of wellbore pressure regimes and the dynamic underbalance phenomena. Further, the apparatus and method of the present invention provide for managing the movement of the gun system and attached pipe or tubing, managing tension and compression in the conveyance tubing and managing the pressure differential applied to packers set in the wellbore above or below the perforating interval.

Broadly stated, the present invention is directed to a downhole tool for use within a wellbore that include a hollow carrier gun body that receives wellbore/formation fluids therein after detonation of a plurality of shaped charges to create a dynamic underbalance pressure condition in the wellbore and a secondary pressure generator disposed within or proximate to the carrier gun body that is used to control the pressure regime in the carrier gun body, the surrounding wellbore or both during the perforating event. This is achieved by predicting and managing the magnitude and the time of the dynamic pressure regime associated with the carrier gun body by introducing a controlled secondary pressure event that counteracts the effect of the empty gun chambers. This secondary event takes place on the order of milliseconds following charge detonation, prior to the creation of the dynamic underbalance condition.

In one aspect, the present invention is directed to a method of determining the pressure that needs to be generated by the secondary pressure generator in the wellbore to offset the dynamic underbalance created by the empty gun chamber using empirical data, software modeling or the like to specifically tailor the perforating gun assembly before deploying to the wellsite.

In another aspect, the present invention is directed to a perforating gun assembly that includes shaped charges that have at least one component that becomes reactive during detonation and serves as the secondary pressure generator. For example, the shaped charge component may be the shaped charge case, the shaped charge liner or the shaped charge explosive. The reaction may manifest itself through either thermal effects, pressure effects or both. In either case, the reaction causes an increase in the pressure within the gun chamber, the near wellbore region or both which counteracts the forces created by the dynamic underbalance condition.

In one embodiment, the shaped charge component may be formed from or may contain a reactive material such as a pyrophoric material, a combustible material, a Mixed Rare Earth (MRE) alloy or the like including, but not limited to, zinc, aluminum, bismuth, tin, calcium, cerium, cesium, hafnium, iridium, lead, lithium, palladium, potassium, sodium, magnesium, titanium, zirconium, cobalt, chromium, iron, nickel, tantalum, depleted uranium, mischmetal or the like or combination, alloys, carbides or hydrides of these materials. In certain embodiments, the shaped charge component may be formed from the above mentioned materials in various powdered metal blends. These powdered metals also may be mixed with oxidizers to form exothermic pyrotechnic compositions, such as thermites. The oxidizers may include, but are not limited to, boron(III) oxide, silicon(IV) oxide, chromium(III) oxide, manganese(IV) oxide, iron(III) oxide, iron(II, III) oxide, copper(II) oxide, lead(II, III, IV) oxide and the like. The thermites also may contain fluorine compounds as additives, such as Teflon. The thermites may include nanothermites in which the reacting constituents are nanoparticles.

In these embodiments, the reactive heat and overpressure caused by the reactive materials counteract the dynamic underbalance condition created by the empty gun chambers. The amount of this counteraction is controlled by the number of shaped charges of the present invention and the ratio of these shaped charges to standard steel case shaped charges, the geometric design of the shaped charges of the present invention, the geometric design of the perforating guns, the composition of the shaped charges and the like.

In one embodiment, the perforating guns are designed with standard steel case shaped charges and shaped charges of the present invention with ratios that can be varied from 1 to 100 up to 100 to 1. In another embodiment, gun carriers loaded with standard steel case shaped charges are assembled with gun carriers loaded with shaped charges of the present invention in gun length ratios that can be varied from 1 to 100 up to 100 to 1.

In a further aspect, the present invention is directed to a perforating gun assembly that includes shaped charges having cases that are surrounded by or are in close proximity to reactive materials. For example, the reactive material may be in the form of a sleeve or a coating disposed on the inner or outer surface of the carrier gun body. In another embodiment, the reactive materials may be nanoparticles that are applied, for example, as a nanolaminate that is disposed on various perforating gun components, such as charge cases, the charge loading tube, the interior or exterior of the carrier gun body or the like. Alternatively or additionally, the reactive materials, in either powder size or nanosize, may be blended into the explosive powder of the shaped charges to generate additional pressure to offset the dynamic underbalance.

In yet another aspect, the present invention is directed to a perforating gun assembly that includes a thermobaric container including one or more of the aforementioned reactive materials that is positioned inside of a carrier gun body or as part of the gun string that generates the desired pressure increase to offset the dynamic underbalance. In one embodiment, the pressure may be released by means of a sleeve or port that opens in response to the detonation of nearby shaped charges or by punch charges that only puncture through the surrounding tubular body but do not create perforation into the wellbore casing.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Figure 1:
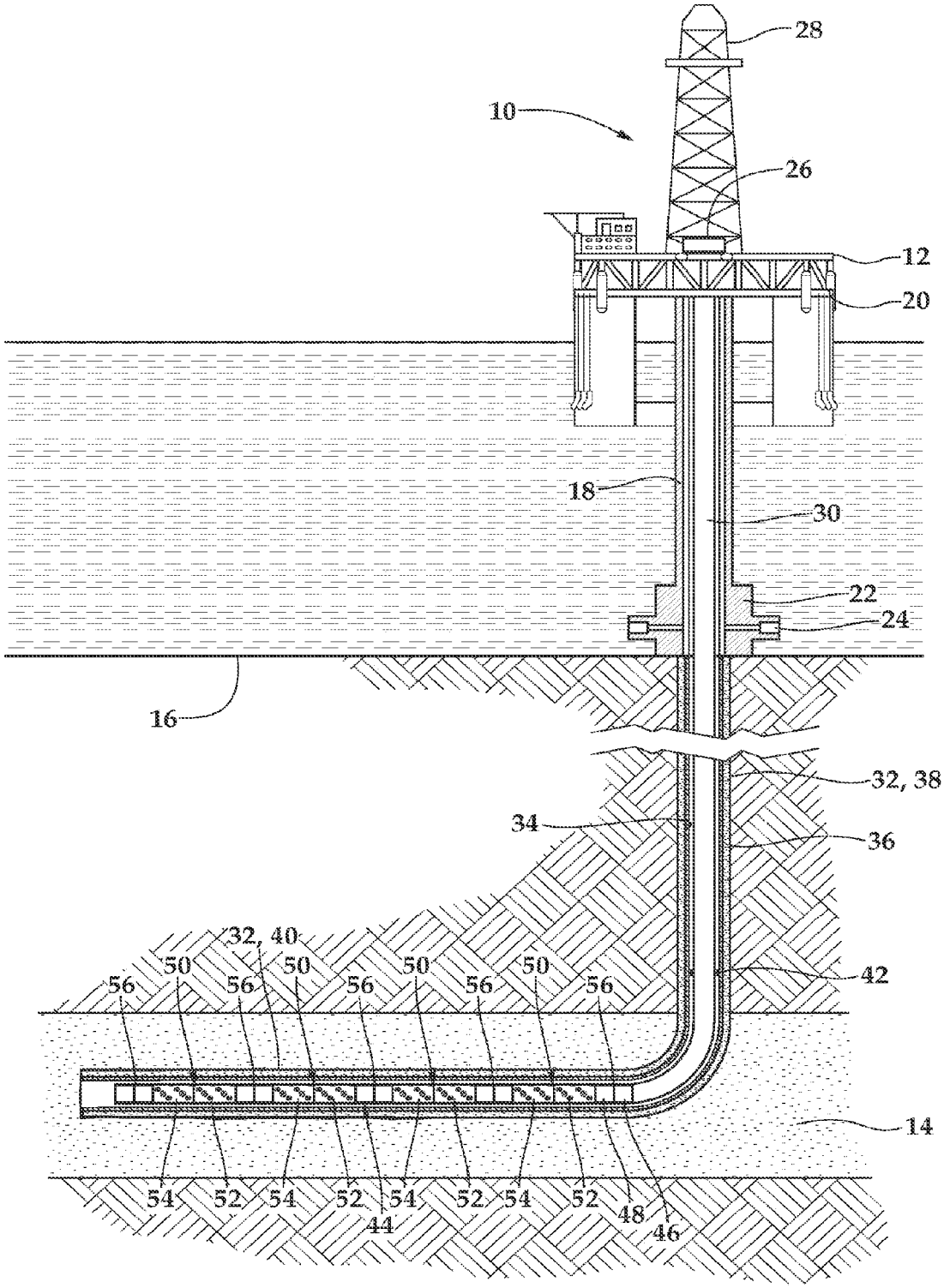
FIG. 1 is a schematic illustration of an offshore oil and gas platform operating a plurality of perforating gun assemblies positioned within a tool string according to an embodiment of the present invention.

Referring initially to FIG. 1, a plurality of perforating gun assemblies of the present invention operating from an offshore oil and gas platform are schematically illustrated and generally designated 10. A semi-submersible platform 12 is centered over a submerged oil and gas formation 14 located below sea floor 16. A subsea conduit 18 extends from deck 20 of platform 12 to wellhead installation 22 including subsea blow-out preventers 24. Platform 12 has a hoisting apparatus 26 and a derrick 28 for raising and lowering pipe strings such as work sting 30.

A wellbore 32 extends through the various earth strata including formation 14. A casing 34 is cemented within wellbore 32 by cement 36. Work string 30 includes various tools such as a plurality of perforating gun assemblies of the present invention. When it is desired to perforate formation 14, work string 30 is lowered through casing 34 until the perforating guns are properly positioned relative to formation 14. Thereafter, the shaped charges within the string of perforating guns are sequentially fired, either in an uphole to downhole or a downhole to uphole direction. Upon detonation, the liners of the shaped charges form jets that create a spaced series of perforations extending outwardly through casing 34, cement 36 and into formation 14, thereby allow formation communication between formation 14 and wellbore 32.

In the illustrated embodiment, wellbore 32 has an initial, generally vertical portion 38 and a lower, generally deviated portion 40 which is illustrated as being horizontal. It should be noted, however, by those skilled in the art that the perforating gun assemblies of the present invention are equally well-suited for use in other well configurations including, but not limited to, inclined wells, wells with restrictions, non-deviated wells and the like.

Work string 30 includes a retrievable packer 42 which may be sealingly engaged with casing 34 in vertical portion 38 of wellbore 32. At the lower end of work string is a gun string, generally designated 44. In the illustrated embodiment, gun string 44 has at its upper or near end a ported nipple 46 below which is a time domain firer 48. Time domain firer 48 is disposed at the upper end of a tandem gun set 50 including first and second guns 52 and 54. In the illustrated embodiment, a plurality of such gun sets 50, each including a first gun 52 and a second gun 54 are utilized. Positioned between each gun set 50 is a blank pipe section 56. Blank pipe sections 56 are used to control and optimize the pressure conditions in wellbore 32 immediately after detonation of the shaped charges. For example, in certain embodiments, blank pipe sections 56 will be used, in addition to the empty gun chambers, to receive a surge of wellbore/formation fluid during the dynamic underbalance pressure condition. In other embodiments, blank pipe sections 56 may serve as secondary pressure generators. For example, blank pipe sections 56 may form thermobaric containers that include reactive material that generates a pressure increase to offset the dynamic underbalance. The reactive material may be in the form of a sleeve or coating on the interior or exterior of blank pipe sections 56 or may be in the form of a component of punch charges that create openings through blank pipe sections 56 but do not perforate casing 34. While tandem gun sets 50 have been described with blank pipe sections 56 therebetween, it should be understood by those skilled in the art that any arrangement of perforating guns may be utilized in conjunction with the present invention including both more or less sections of blank pipe as well as no sections of blank pipe, without departing from the principles of the present invention.

Upon detonation of the shaped charges in perforating guns of gun string 44, there is an initial pressure increase in the gun chambers and near wellbore region created by the detonation gases. Simultaneously with or immediately after the detonation event, the secondary pressure generators of the present invention further increase the pressure within gun chambers, the near wellbore region or both. The secondary pressure generators are utilized to optimize the wellbore pressure regime by controlling the dynamic underbalance created by the empty gun chambers and more specifically, by preventing excessive dynamic underbalance which may detrimentally effect the perforating operation including causing sanding of the newly formed perforations, causing undesirably large movement of the gun system and the attached tubular string, causing high tensile and compressive loads on the conveyance tubing and causing extreme pressure differentials to be applied against previously set packers both above and below the perforating interval.

Figure 2:
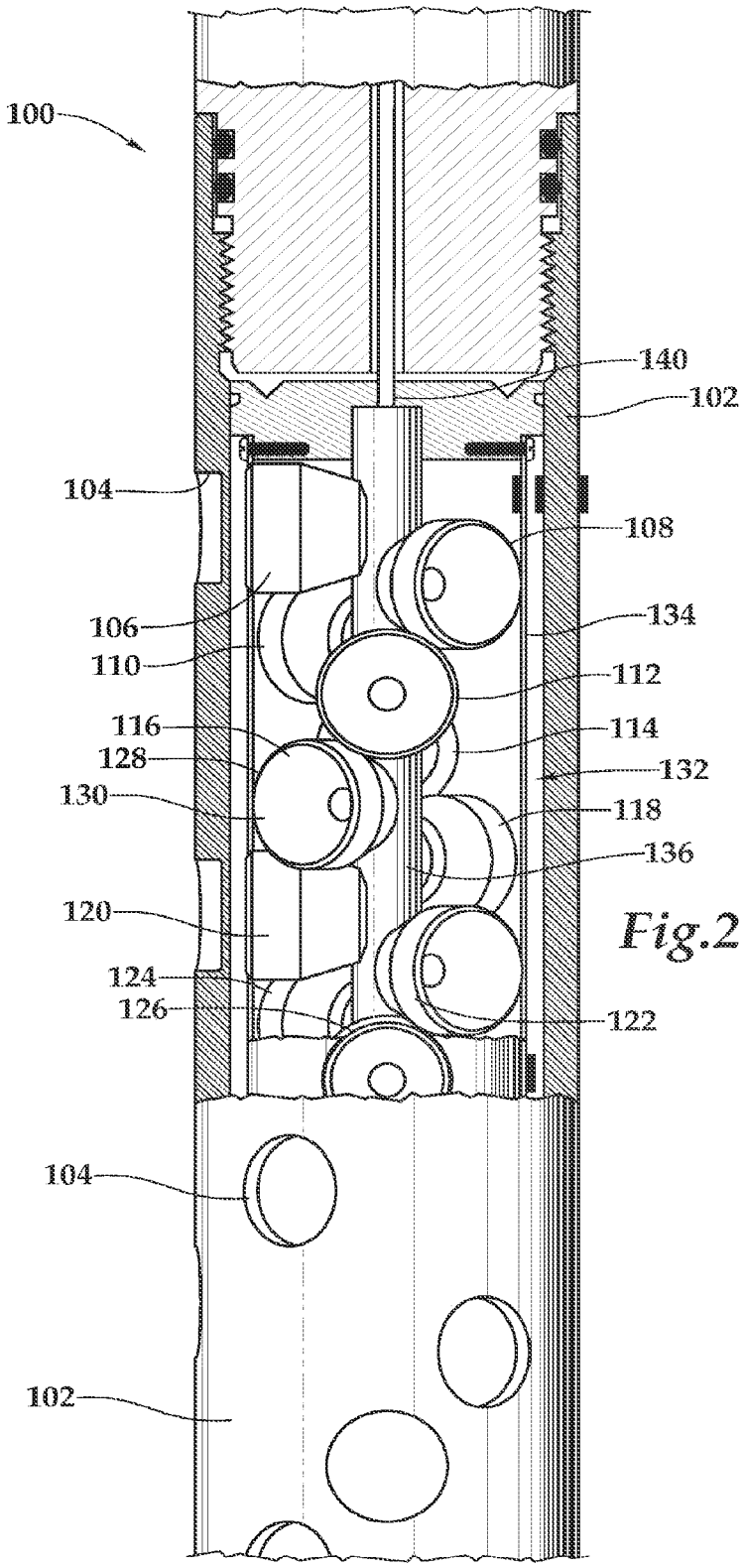
FIG. 2 is partial cut away view of a perforating gun assembly according to an embodiment of the present invention.

Referring now to FIG. 2, therein is depicted a perforating gun assembly of the present invention that is generally designated 100. Perforating gun 100 includes a carrier gun body 102 made of a cylindrical sleeve having a plurality of radially reduced areas depicted as scallops or recesses 104. Radially aligned with each of the recesses 104 is a respective one of a plurality of shaped charges, only eleven of which, shaped charges 106-126, are visible in FIG. 2. Each of the shaped charges, such as shaped charge 116 includes an outer housing, such as housing 128, and a liner, such as liner 130. Disposed between each housing and liner is a quantity of high explosive.

The shaped charges are retained within carrier gun body 102 by a charge holder 132 which includes an outer charge holder sleeve 134 and an inner charge holder sleeve 136. In this configuration, outer charge holder sleeve 134 supports the discharge ends of the shaped charges, while inner charge holder sleeve 136 supports the initiation ends of the shaped charges. Disposed within inner charge holder sleeve 136 is a detonator cord 140, such as a Primacord, which is used to detonate the shaped charges. In the illustrated embodiment, the initiation ends of the shaped charges extend across the central longitudinal axis of perforating gun 100 allowing detonator cord 140 to connect to the high explosive within the shaped charges through an aperture defined at the apex of the housings of the shaped charges.

Each of the shaped charges is longitudinally and radially aligned with one of the recesses 104 in carrier gun body 102 when perforating gun 100 is fully assembled. In the illustrated embodiment, the shaped charges are arranged in a spiral pattern such that each of the shaped charge is disposed on its own level or height and is to be individually detonated so that only one shaped charge is fired at a time. It should be understood by those skilled in the art, however, that alternate arrangements of shaped charges may be used, including cluster type designs wherein more than one shaped charge is at the same level and is detonated at the same time, without departing from the principles of the present invention.

Perforating gun 100 includes a plurality of secondary pressure generators that are formed as a component of or coating on certain of the shaped charges contained therein. In the illustrated embodiment, shaped charges 106, 116 and 126 include the secondary pressure generators. As such, perforating gun 100 has a 4 to 1 ratio of standard shaped charges to shaped charges of the present invention that include secondary pressure generators. Even though a particular ratio has been described and depicted in FIG. 2, those skilled in the art should recognize that other ratios both greater than and less than 4 to 1 are also possible and considered within the scope of the present invention. For example, in certain implementations, a greater ratio such as a 10 to 1 ratio is desirable. In other implementations a 20 to 1 ratio, a 50 to 1 ratio and up to a 100 to 1 ratio may be desirable. Likewise, lesser ratios may also be desirable including, but not limited to, a 1 to 1 ratio, a 1 to 4 ratio, a 1 to 10 ratio, a 1 to 20 ratio, a 1 to 50, a 1 to 100 ratio as well as any other ratio between 100 to 1 and 1 to 100. In addition, in certain embodiments, it may be desirable for all of shaped charges to include secondary pressure generators.

The secondary pressure generators may be formed as all or a part of a charge case such as charge case 128 including as a coating on the charge case, a liner such as liner 130 or the explosive within a shaped charge such as shaped charge 126. Preferably, the secondary pressure generators are formed from a reactive material such as a pyrophoric materials, a combustible material, a Mixed Rare Earth (MRE) alloy or the like including, but not limited to, zinc, aluminum, bismuth, tin, calcium, cerium, cesium, hafnium, iridium, lead, lithium, palladium, potassium, sodium, magnesium, titanium, zirconium, cobalt, chromium, iron, nickel, tantalum, depleted uranium, mischmetal or the like or combination, alloys, carbides or hydrides of these materials. In certain embodiments, the secondary pressure generators may be formed from the above mentioned materials in various powdered metal blends. These powdered metals also may be mixed with oxidizers to form exothermic pyrotechnic compositions, such as thermites. The oxidizers may include, but are not limited to, boron(III) oxide, silicon(IV) oxide, chromium(III) oxide, manganese (IV) oxide, iron(III) oxide, iron(II, III) oxide, copper(II) oxide, lead(II, III, IV) oxide and the like. The thermites also may contain fluorine compounds as additives, such as Teflon. The thermites may include nanothermites in which the reacting constituents are nanoparticles. The reaction generated by the secondary pressure generators may manifest itself through a thermal effect, a pressure effect or both. In either case, the reaction causes an increase in the pressure within perforating gun 100, the near wellbore region or both which counteracts the forces created by the dynamic underbalance condition in the wellbore.

Figure 3:
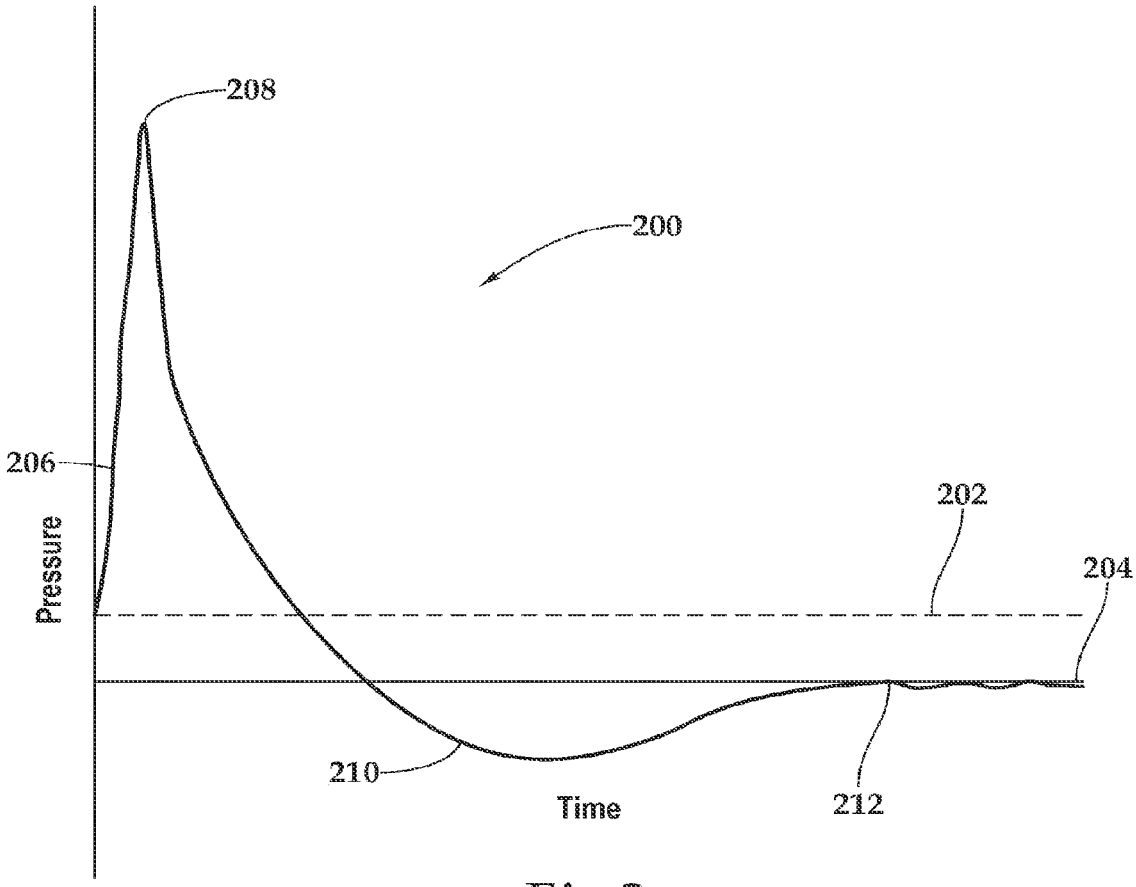
FIG. 3 is a pressure versus time diagram illustrating an average pressure profile in a perforating interval according to an embodiment of the present invention.

Referring now to FIG. 3, a pressure versus timing graph illustrating the average pressure in a perforating interval and generally designated 200. As illustrated, the initial static overbalance pressure condition in the wellbore is depicted as dashed line 202. The static overbalance pressure may be between about 200 psi and about 1000 psi over reservoir pressure, which is indicated at 204. Even though a particular static overbalance pressure range has been described, other static overbalance pressures both greater than 1000 psi and less than 200 psi could also be used with the pressure invention. Likewise, even though a static overbalance pressure is depicted, the present invention could also be used in wellbore having an initial balanced pressure condition or static underbalance pressure condition.

Upon detonation of the shaped charges within the perforating gun or gun string an initial and relatively small dynamic overbalance condition is generated in the near wellbore region that is indicated at 206. The activation of the various perforating charges in the overall gun string may be activated within microseconds of one another due to the use of the common detonation device. While not truly simultaneous, the detonation may be referred to as being activated substantially concurrently to account for the activation time differences occurring due to the use of the detonation device. Immediately thereafter, the secondary pressure generators of the present invention react to create a secondary pressure event in the form of a relatively large dynamic overbalance condition in the near wellbore region, the peak of which is indicated at 208. In one implementation, the pressure peak of the secondary pressure event occurs within about 100 milliseconds of the detonation of the shaped charges. In another implementation, the pressure peak of the secondary pressure event occurs within about 50 milliseconds of the detonation of the shaped charges. In a further implementation, the pressure peak of the secondary pressure event occurs within about 20 milliseconds of the detonation of the shaped charges. In yet another implementation, the pressure peak of the secondary pressure event occurs within about 10 milliseconds of the detonation of the shaped charges. In an additional implementation, the pressure peak of the secondary pressure event occurs between about 1 millisecond and about 10 milliseconds after the detonation of the shaped charges. In a further implementation, the pressure peak of the secondary pressure event occurs between about 100 microseconds and about 1 millisecond after the detonation of the shaped charges. In another implementation, the pressure peak of the secondary pressure event occurs between about 10 microseconds and about 100 microseconds after the detonation of the shaped charges. The particular implementation to be used is determined based upon empirical data, software modeling or the like and is accomplished using the type and amount of reactive material necessary to achieve a secondary pressure event having the desired pressure profile with a peak pressure at the desired time frame.

The empty volume within the perforating guns and any associated blank pipe then generates a dynamic underbalance condition in the near wellbore region that is indicated at 210. After a short time, the wellbore pressure stabilizes at reservoir pressure as indicated at 212. Importantly, use of the secondary pressure generators of the present invention increases the pressure in the near wellbore region which reduces both the peak and the duration of the dynamic underbalance condition in the near wellbore region, thereby counteracting the forces created by the dynamic underbalance condition in the wellbore and preventing an excessive dynamic underbalance condition in the wellbore.

As discussed above, the secondary pressure generators may be formed as all or a part of a charge case. In an embodiment, the secondary pressure generators may comprise a metal that is at least partly combustible including any of those metals listed herein. For example, the charge case may comprise zinc and the resulting charge may be referred to as a zinc charge. Upon detonation of the charge, a reaction between the metal and the available oxygen may produce at least some combustion products that produce a pressure effect responsible for balancing the dynamic underbalance created during the perforating process.

In an embodiment, the perforating guns are designed with a portion of the perforating charges that are not operably associated with a secondary pressure generator. For example, standard steel case shaped charges may not be associated with the secondary pressure generator. In an embodiment, the ratio of the number of perforating charges not operably associated with the secondary pressure generator and the number of perforating charges comprising a secondary pressure generator can be varied from about 1 to 100 (i.e., 1:100) up to about 100 to 1 (i.e., 100:1). In another embodiment, gun carriers loaded with standard steel case shaped charges are assembled with gun carriers loaded with perforating charges comprising a secondary pressure generator in gun length ratios that can be varied from 1 to 100 up to 100 to 1. In an embodiment, the gun length may be fixed at a desired length (e.g., at a standard size as used in the industry) and gun carriers loaded with standard steel case perforating charges may be assembled along with additional gun carriers loaded with perforating charges comprising secondary pressure generators. The ratio of gun carriers comprising standard steel case perforating charges to gun carriers comprising perforating charges comprising secondary pressure generators can be varied from 1 to 100 up to 100 to 1, and the spatial distribution of each type of gun carrier can be determined using any of the methods described herein. As used herein, the term "about", when used in reference to a numerical value or range, refers to a value within 5% of the stated value or range.

In an embodiment, the perforating charges (e.g., shaped charges) used to perforate the wellbore may comprise various types of perforating charges as known in the art. For example, the perforating charges may comprise one or more of a big-hole charge and/or a deep penetration charge. A big-hole charge is a perforating charge designed to create perforations with a large-diameter entrance hole. The big-hole charges may create a larger diameter entrance hole at the cost of a reduced penetration depth of the overall perforation tunnel in the formation. Big-hole charges may be used in a variety of operations including, but not limited to, sand and gravel pack completions in high-permeability formations, completions that are to be followed by hydraulic fracturing, and/or completions using a combination of hydraulic fracturing and gravel packing, which are commonly referred to as a frac-pack operation. A deep-penetrating charge is a perforating charge designed to provide a long perforation tunnel into the formation. The deep-penetrating charge may create a longer perforation tunnel at the cost of a small to medium sized entrance hole, which may be used with a higher shot density (e.g., as measured by shots per foot of wellbore) to compensate for the reduced entrance hole size relative to the big-hole charges. Deep-penetrating charges may be used in a variety of operations including, but not limited to, operations in which near-wellbore damage exists and the perforation tunnels need to extend through the damage, and/or low permeability formations.

In an embodiment, one or more perforating charges comprising the secondary pressure generators may be formed as big-hole charges. For example, one or more zinc charges may be formed as big-hole charges. In an embodiment, one or more perforating charges comprising the secondary pressure generators may be formed as deep-penetrating charges. In an embodiment, one or more perforating charges comprising the secondary pressure generators may be formed as both big-hole charges and deep-penetrating charges. The standard steel perforating charges also may comprise big-hole charges and/or deep-penetrating charges. The extent of the pressure effects, including both the maximum overpressure and underpressure, may be affected at least in part by the hole size and depth of the perforation tunnels, as described in more detail below.

The ratio of deep-penetrating charges to big-hole charges may be used to alter the dynamic pressures during the perforation process. In an embodiment, the ratio of deep-penetrating charges to big-hole charges may be greater than 1 to 1. For example, in certain embodiments, a greater ratio such as a 10 to 1 ratio is desirable. In other implementations a 20 to 1 ratio, a 50 to 1 ratio and up to a 100 to 1 ratio may be desirable. In an embodiment, the ratio of deep-penetrating charges to big-hole charges may be less than 1 to 1. For example, the ratio may include, but is not limited to, a 1 to 4 ratio, a 1 to 10 ratio, a 1 to 20 ratio, a 1 to 50, a 1 to 100 ratio as well as any other ratio between 100 to 1 and 1 to 100. In addition, in certain embodiments, it may be desirable for all of the perforating charges to be either big-hole charges or deep-penetrating charges. The spatial distribution of each type of perforating charge can be determined using any of the methods described herein.

The effects of the secondary pressure generators may be localized within the wellbore. For example, the pressure versus timing graph illustrated in FIG. 3, represents the pressure within the wellbore at a specific location during the perforating process. The pressure peaks and duration of the dynamic underbalance condition may change along the length of the perforating zone. In an embodiment, perforating charges comprising secondary pressure generators may be distributed in the gun string to prevent excessive peak pressures such as an excessive dynamic underbalance condition and/or overbalance condition at a selected location in the wellbore.

In an embodiment, the use of secondary pressure generators may be limited to locations near a selected location to prevent excessive conditions at that point. For example, a dynamic pressure resulting from the perforation process may cause excess tension or compression across a zonal isolation device such as the retrievable packer 42 and in some cases may cause the associated conveyance tubing to move, potentially damaging the work string and its various components. The use of secondary pressure generators may be limited to the areas of the gun string near to the zonal isolation device. Additional locations of interest along the work string may include the perforations themselves, the gun string and its components, the work string components above the gun string, and any additional components below the gun string, such as any zonal isolation devices (e.g., bridge plugs) below the gun string.

Each of the selected locations may have a threshold representing the maximum overpressure or underpressure that the selected location can withstand before experiencing adverse effects. For example, the zonal isolation devices and other components of the work string may be designed for a maximum operating pressure differential, which can occur in either a dynamic or static overpressure or underpressure condition. If the maximum operating pressure differential is exceeded, the component may fail or be subjected to movement. For example, a retrievable packer may experience movement within the wellbore upon as a result of experiencing a pressure differential in excess of the threshold, potentially damaging the associated work string due to unintended movement within the wellbore. In an embodiment the work string components may be designed to withstand a maximum operating pressure differential (e.g., an overpressure and/or underpressure) of about 20,000 psi, alternatively about 15,000 psi, alternatively about 10,000 psi, or alternatively about 5,000 psi. Similarly, the perforations may have a threshold for the maximum overpressure conditions and the maximum underpressure condition, which may be the same or different. Overpressures or underpressures exceeding the threshold may result in collapse, sanding, and/or other damage to the perforation. In an embodiment, a threshold for the perforations may comprise the fracture pressure of the formation, and the gun string assembly may be configured to prevent the pressure at or near the perforation from exceeding the fracture pressure of the formation during the perforating process. The gun string may have a maximum overpressure and/or underpressure thresholds, which may be based on maintaining the structural integrity of the gun string and its components. The components below the gun string also may have maximum operating pressure differentials. Pressure conditions exceeding these thresholds may result in damage (e.g., movement) and/or failure of the components below the gun string. In an embodiment, one or more of the thresholds of the selected locations may vary. For example, the pressure thresholds for the perforations may be greater than or less than the maximum operating pressure differentials of the work string components. In order to protect the various selected locations, the use of secondary pressure generators may be non-uniform along the length of the gun string to take the thresholds of a plurality of selected locations into account. The resulting pressure profile along the gun string and/or the work string resulting from the perforating process may vary.

As described above with reference to FIG. 3, the pressure transient that results from the perforation charges and the secondary pressure generators may be affected by several factors. The exemplary pressure transient, as depicted in FIG. 3 and described in more detail above, generally comprises at least one of an initial overbalance condition in the near wellbore region 206, a peak overbalance condition in the near wellbore region 208, a peak or maximum underbalance condition 210, a stabilized reservoir pressure 212, and a transient length. In an embodiment, the pressure transient including the peaks and overall duration may be affected by the total number of perforating charges, the number of perforating charges operably associated with the secondary pressure generator, the number of perforating charges not operably associated with the secondary pressure generator (e.g., standard steel charges), the geometric design of the perforating charges, the spatial layout of the perforating charges along the gun string, the layout of the gun carriers along the gun string, the geometric design of the perforating guns, the composition of the perforating charges, the number and location of blank pipe sections (i.e., blank guns) used, if any, the timing of the firing of the charges, and any combination thereof. Further considerations may include the properties of the subterranean formation (e.g., porosity, formation pressure, formation temperature, etc.), and/or the hole size of the perforation tunnels, which can be affected by the choice of perforation types (e.g., big-hole charges, deep-penetration charges, etc.). Additional considerations as known to those of ordinary skill in the art with the benefit of this disclosure may also affect the pressure transient created in the near wellbore region during the perforation process.

The design of the work string and/or gun string for the perforation process may be determined based on empirical data and/or software modeling or the like. In an embodiment, a process for designing the work string and/or gun string may comprise using empirical data and/or standard gun string and/or work string designs to determine an initial design of the work string and/or gun string. A computer executing a software model may then be used to determine one or more pressure transients at one or more selected locations in the wellbore. Suitable software models are commercially available that can be utilized to determine a pressure transient during a perforation process, for example PULSFRAC software, SHOCKPRO software, or SURGEPRO software available from Halliburton Energy Services of Houston, Tex. The pressure transients resulting from the initial design can be compared against the applicable thresholds at the selected locations. If the pressure transients meet the thresholds, then the design may be used to perforate the wellbore. If one or more pressure transient at a selected location shows one or more pressures (e.g., at the peak overbalance condition, the maximum underbalance condition, stabilized reservoir pressure, etc.) that exceed one or more thresholds, then the initial design of the work string and/or gun string may be redetermined. For example, if the pressure differential across a zonal isolation device exceeds the threshold for the device (e.g., about 10,000 psi, alternatively about 15,000 psi), then the configuration of the string may be redetermined to reduce the pressure differential across the zonal isolation device to less than the threshold. In an embodiment, only those portions of the gun string that exceed the applicable threshold may be redetermined. Any of the components and/or methods described herein may be used to alter the transient pressure profile at the selected location. For example, if the maximum underbalance condition has a pressure below an applicable threshold, additional secondary pressure generating charges may be placed in or near the selected location. Alternatively, if the peak overbalance condition exceeds a pressure threshold, fewer perforating charges comprising a secondary pressure generator may be used or the timing of the firing may be delayed to broaden the overbalance pressure spike and reduce the peak overbalance pressure. Any of the other methods described herein may also be used.

An iterative process then may be used to determine the design of the work string and/or gun string for the perforation process. For example, the computer executing the software model then may be used to determine one or more pressure transients at one or more selected locations in the wellbore based on the second work string and/or gun string design. The pressure transients determined by the computer from the second design can be checked against the applicable thresholds at the selected locations. If the pressure transients resulting from the second design meet the thresholds, then the second design may be used to perforate the wellbore. If one or more of the pressure transients show one or more pressures (e.g., at the peak overbalance condition, the maximum underbalance condition, stabilized reservoir pressure, etc.) that exceed one or more thresholds, then the second design of the work string and/or gun string may be further redetermined. This process may be repeated a third, fourth, fifth, or subsequent time until a configuration of the work string and/or gun string design is determined that satisfies the pressure thresholds at each selected location. This method may allow for the use of larger perforating charges and/or more perforating charges for perforating a zone of interest in fewer trips without damaging the work string and the associated equipment. In an embodiment, the method disclosed herein may allow for a formation to perforated in a single trip into the wellbore rather than a plurality of trips.

In an embodiment, a pressure measurement device such as a pressure transducer may be incorporated into the work string and/or gun string in a location that allows for the pressure transient to be measured during the perforation process. The resulting pressure transient data may be used with the software model to calibrate the model in future pressure transient predictions. In an embodiment, the iterative process described herein may be fully automated using standard design rules to create an initial work string and/or gun string design followed by automatically redesigning the string as needed to satisfy the pressure thresholds at each location of interest.

Figure 4:
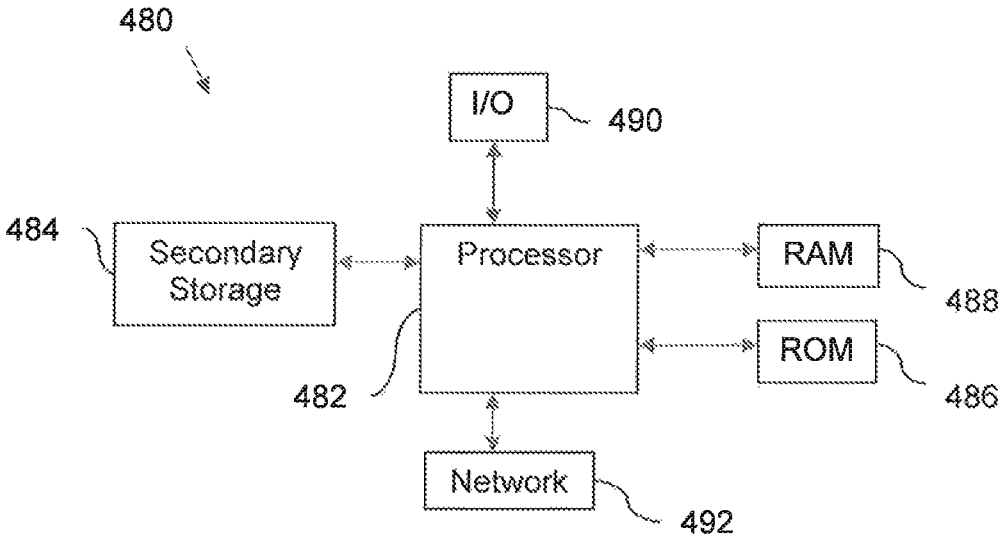
FIG. 4 is an illustrative example of a computer.

The software model and other methods described above, or any portions thereof, may be implemented on any computer with sufficient processing power, memory resources, and network throughput capability to handle the necessary workload placed upon it. FIG. 4 illustrates a typical, computer system suitable for implementing one or more embodiments disclosed herein. The computer system 480 includes a processor 482 (which may be referred to as a central processor unit or CPU) that is in communication with memory devices including secondary storage 484, read only memory (ROM) 486, random access memory (RAM) 488, input/output (I/O) devices 490, and network connectivity devices 492. The processor may be implemented as one or more CPU chips.

It is understood that by programming and/or loading executable instructions onto the computer system 480, at least one of the CPU 482, the RAM 488, and the ROM 486 are changed, transforming the computer system 480 in part into a particular machine or apparatus having the novel functionality taught by the present disclosure. It is fundamental to the electrical engineering and software engineering arts that functionality that can be implemented by loading executable software into a computer can be converted to a hardware implementation by well known design rules. Decisions between implementing a concept in software versus hardware typically hinge on considerations of stability of the design and numbers of units to be produced rather than any issues involved in translating from the software domain to the hardware domain. Generally, a design that is still subject to frequent change may be preferred to be implemented in software, because re-spinning a hardware implementation is more expensive than re-spinning a software design. Generally, a design that is stable that will be produced in large volume may be preferred to be implemented in hardware, for example in an application specific integrated circuit (ASIC), because for large production runs the hardware implementation may be less expensive than the software implementation. Often a design may be developed and tested in a software form and later transformed, by well known design rules, to an equivalent hardware implementation in an application specific integrated circuit that hardwires the instructions of the software. In the same manner as a machine controlled by a new ASIC is a particular machine or apparatus, likewise a computer that has been programmed and/or loaded with executable instructions may be viewed as a particular machine or apparatus.

The secondary storage 484 is typically comprised of one or more disk drives or tape drives and is used for non-volatile storage of data and as an over-flow data storage device if RAM 488 is not large enough to hold all working data. Secondary storage 484 may be used to store programs which are loaded into RAM 488 when such programs are selected for execution. The ROM 486 is used to store instructions and perhaps data which are read during program execution. ROM 486 is a non-volatile memory device which typically has a small memory capacity relative to the larger memory capacity of secondary storage 484. The RAM 488 is used to store volatile data and perhaps to store instructions. Access to both ROM 486 and RAM 488 is typically faster than to secondary storage 484. The secondary storage 484, the RAM 488, and/or the ROM 486 may be referred to in some contexts as computer readable storage media and/or non-transitory computer readable media.

I/O devices 490 may include printers, video monitors, liquid crystal displays (LCDs), touch screen displays, keyboards, keypads, switches, dials, mice, track balls, voice recognizers, card readers, paper tape readers, or other well-known input devices.

The network connectivity devices 492 may take the form of modems, modem banks, Ethernet cards, universal serial bus (USB) interface cards, serial interfaces, token ring cards, fiber distributed data interface (FDDI) cards, wireless local area network (WLAN) cards, radio transceiver cards such as code division multiple access (CDMA), global system for mobile communications (GSM), long-term evolution (LTE), worldwide interoperability for microwave access (WiMAX), and/or other air interface protocol radio transceiver cards, and other well-known network devices. These network connectivity devices 492 may enable the processor 482 to communicate with the Internet or one or more intranets. With such a network connection, it is contemplated that the processor 482 might receive information from the network, or might output information to the network in the course of performing the above-described method steps. Such information, which is often represented as a sequence of instructions to be executed using processor 482, may be received from and outputted to the network, for example, in the form of a computer data signal embodied in a carrier wave.

Such information, which may include data or instructions to be executed using processor 482 for example, may be received from and outputted to the network, for example, in the form of a computer data baseband signal or signal embodied in a carrier wave. The baseband signal or signal embodied in the carrier wave generated by the network connectivity devices 492 may propagate in or on the surface of electrical conductors, in coaxial cables, in waveguides, in an optical conduit, for example an optical fiber, or in the air or free space. The information contained in the baseband signal or signal embedded in the carrier wave may be ordered according to different sequences, as may be desirable for either processing or generating the information or transmitting or receiving the information. The baseband signal or signal embedded in the carrier wave, or other types of signals currently used or hereafter developed, may be generated according to several methods well known to one skilled in the art. The baseband signal and/or signal embedded in the carrier wave may be referred to in some contexts as a transitory signal.

The processor 482 executes instructions, codes, computer programs, scripts which it accesses from hard disk, floppy disk, optical disk (these various disk based systems may all be considered secondary storage 484), ROM 486, RAM 488, or the network connectivity devices 492. While only one processor 482 is shown, multiple processors may be present. Thus, while instructions may be discussed as executed by a processor, the instructions may be executed simultaneously, serially, or otherwise executed by one or multiple processors. Instructions, codes, computer programs, scripts, and/or data that may be accessed from the secondary storage 484, for example, hard drives, floppy disks, optical disks, and/or other device, the ROM 486, and/or the RAM 488 may be referred to in some contexts as non-transitory instructions and/or non-transitory information.

In an embodiment, the computer system 480 may comprise two or more computers in communication with each other that collaborate to perform a task. For example, but not by way of limitation, an application may be partitioned in such a way as to permit concurrent and/or parallel processing of the instructions of the application. Alternatively, the data processed by the application may be partitioned in such a way as to permit concurrent and/or parallel processing of different portions of a data set by the two or more computers. In an embodiment, virtualization software may be employed by the computer system 480 to provide the functionality of a number of servers that is not directly bound to the number of computers in the computer system 480. For example, virtualization software may provide twenty virtual servers on four physical computers. In an embodiment, the functionality disclosed above may be provided by executing the application and/or applications in a cloud computing environment. Cloud computing may comprise providing computing services via a network connection using dynamically scalable computing resources. Cloud computing may be supported, at least in part, by virtualization software. A cloud computing environment may be established by an enterprise and/or may be hired on an as-needed basis from a third party provider. Some cloud computing environments may comprise cloud computing resources owned and operated by the enterprise as well as cloud computing resources hired and/or leased from a third party provider.

In an embodiment, some or all of the functionality disclosed above may be provided as a computer program product. The computer program product may comprise one or more computer readable storage medium having computer usable program code embodied therein to implement the functionality disclosed above. The computer program product may comprise data structures, executable instructions, and other computer usable program code. The computer program product may be embodied in removable computer storage media and/or non-removable computer storage media. The removable computer readable storage medium may comprise, without limitation, a paper tape, a magnetic tape, magnetic disk, an optical disk, a solid state memory chip, for example analog magnetic tape, compact disk read only memory (CD-ROM) disks, floppy disks, jump drives, digital cards, multimedia cards, and others. The computer program product may be suitable for loading, by the computer system 480, at least portions of the contents of the computer program product to the secondary storage 484, to the ROM 486, to the RAM 488, and/or to other non-volatile memory and volatile memory of the computer system 480. The processor 482 may process the executable instructions and/or data structures in part by directly accessing the computer program product, for example by reading from a CD-ROM disk inserted into a disk drive peripheral of the computer system 480. Alternatively, the processor 482 may process the executable instructions and/or data structures by remotely accessing the computer program product, for example by downloading the executable instructions and/or data structures from a remote server through the network connectivity devices 492. The computer program product may comprise instructions that promote the loading and/or copying of data, data structures, files, and/or executable instructions to the secondary storage 484, to the ROM 486, to the RAM 488, and/or to other non-volatile memory and volatile memory of the computer system 480.

In some contexts, a baseband signal and/or a signal embodied in a carrier wave may be referred to as a transitory signal. In some contexts, the secondary storage 484, the ROM 486, and the RAM 488 may be referred to as a non-transitory computer readable medium or a computer readable storage media. A dynamic RAM embodiment of the RAM 488, likewise, may be referred to as a non-transitory computer readable medium in that while the dynamic RAM receives electrical power and is operated in accordance with its design, for example during a period of time during which the computer 480 is turned on and operational, the dynamic RAM stores information that is written to it. Similarly, the processor 482 may comprise an internal RAM, an internal ROM, a cache memory, and/or other internal non-transitory storage blocks, sections, or components that may be referred to in some contexts as non-transitory computer readable media or computer readable storage media.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A downhole tool gun string assembly comprising:

a first perforating gun operable to generate a first pressure at a first location in a wellbore, wherein the first perforating gun comprises a first plurality of perforating charges;

a second perforating gun operable to generate a second pressure at a second location in the wellbore, wherein the second pressure is different from the first pressure and the second perforating gun comprises a second plurality of perforating charges, and wherein at least one of the second plurality of perforating charges is operably associated with a secondary pressure generator, wherein the first perforating gun and the second perforating gun are configured to maintain a pressure at a selected location in the wellbore below a threshold when the first perforating gun and the second perforating gun are activated substantially concurrently.

2. The gun string assembly of claim 1, further comprising a blank pipe section disposed between the first perforating gun and the second perforating gun.

3. The gun string assembly of claim 1, wherein at least one perforating charge of the second plurality of perforating charges is not operably associated with a secondary pressure generator, and wherein the ratio of perforating charges not operably associated with the secondary pressure generator to the at least one perforating charges that are operably associated with the secondary pressure generator is between about 1:100 and 100:1.

4. The gun string assembly of claim 1, wherein the first plurality of perforating charges are not operably associated with a secondary pressure generator, and wherein the second plurality of perforating charges are all operably associated with a secondary pressure generator.

5. The gun string assembly of claim 4, wherein the threshold at the location is a pressure differential across a zonal isolation device of about 20,000 psi.

6. The gun string assembly of claim 1, wherein the at least one of the second plurality of perforating charges that is operably associated with a secondary pressure generator comprises at least one of: a big-hole charge, and a deep-penetrating charge.

7. The gun string assembly of claim 1, wherein the secondary pressure generator comprises a coating on the at least one of the second plurality of perforating charges.

8. The gun string assembly of claim 1, wherein the secondary pressure generator comprises at least a portion of a charge case of the at least one of the second plurality of perforating charges.

9. The gun string assembly of claim 1, wherein the secondary pressure generator comprises at least a portion of a liner of the at least one of the second plurality of perforating charges.

10. The gun string assembly of claim 1, wherein the secondary pressure generator comprises at least a portion of an explosive of the at least one of the second plurality of perforating charges.

11. The gun string assembly of claim 1, wherein the secondary pressure generator comprises a reactive material selected from the group consisting of:

a phyrophoric material, a combustible material, a mixed rare earth alloy, a pyrotechnic composition, and any combination thereof.

12. The gun string assembly of claim 1, wherein the secondary pressure generator comprises a material selected from the group consisting of: zinc, aluminum, bismuth, tin, calcium, cerium, cesium, hafnium, iridium, lead, lithium, palladium, potassium, sodium, magnesium, titanium, zirconium, cobalt, chromium, iron, nickel, tantalum, depleted uranium, mischmetal, any alloy thereof, any carbide thereof, any hydride thereof, and any combination thereof.

13. The gun string assembly of claim 1, wherein the secondary pressure generator comprises a material selected from the group consisting of: boron(III) oxide, silicon(IV) oxide, chromium(III) oxide, manganese(IV) oxide, iron(III) oxide, iron(II, III) oxide, copper(II) oxide, lead(II, III, IV) oxide, and any combination thereof.

14. A downhole tool gun string assembly comprising:

a first perforating gun operable to generate a first pressure at a first location in a wellbore, wherein the first perforating gun comprises a first plurality of perforating charges;

a second perforating gun operable to generate a second pressure at a second location in the wellbore, wherein the second perforating gun comprises a second plurality of perforating charges;

a blank pipe section disposed between the first perforating gun and the second perforating gun, wherein the blank pipe section comprises a secondary pressure generator, and wherein the secondary pressure generator is operably associated with at least one of the first perforating gun or the second perforating gun, wherein the first perforating gun, the second perforating gun, and the blank pipe section are configured to maintain a pressure at a selected location in the wellbore below a threshold when the first perforating gun and the second perforating gun are activated substantially concurrently.

15. The gun string assembly of claim 14, wherein the blank pipe section comprises a thermobaric container comprising a reactive material.

16. The gun string assembly of claim 14, wherein the reactive material comprises at least one of a sleeve or a coating on the interior of the blank pipe section.

17. The gun string assembly of claim 14, wherein the reactive material comprises at least one of a sleeve or coating on the exterior of the blank pipe section.

18. The gun string assembly of claim 14, wherein the reactive material comprises a component of a punch charge, wherein the punch charge is configured to create an opening through the blank pipe section.

19. The gun string assembly of claim 14, wherein the secondary pressure generator comprises a reactive material selected from the group consisting of:

a phyrophoric material, a combustible material, a mixed rare earth alloy, a pyrotechnic composition, and any combination thereof.

20. The gun string assembly of claim 14, wherein the secondary pressure generator comprises a material selected from the group consisting of: zinc, aluminum, bismuth, tin, calcium, cerium, cesium, hafnium, iridium, lead, lithium, palladium, potassium, sodium, magnesium, titanium, zirconium, cobalt, chromium, iron, nickel, tantalum, depleted uranium, mischmetal, any alloy thereof, any carbide thereof, any hydride thereof, and any combination thereof.

* * * * *